US005528904A

United States Patent [19]

Jones et al.

[11] Patent Number: 5,528,904

[45] Date of Patent: Jun. 25, 1996

[54] COATED HOT GAS DUCT LINER

[76] Inventors: Charles R. Jones, 3697 Holly Dr., Palm Beach Gardens, Fla. 33410; George J. Kramer, 102 Sea Steppes Ct., Jupiter, Fla. 33477; Arthur Cordes, 412 King Charles Cir., Summerville, S.C. 29485

[21] Appl. No.: 203,166

[22] Filed: Feb. 28, 1994

[51] Int. Cl.[6] ..... F23R 3/06

[52] U.S. Cl. ..... 60/753; 60/757

[58] Field of Search ..... 60/755, 752, 753, 60/757, 39.31, 909

[56] References Cited

U.S. PATENT DOCUMENTS

| | | | |
|---|---|---|---|
| 4,077,205 | 3/1978 | Pane et al. | 60/757 |
| 4,184,326 | 1/1980 | Pane, Jr. et al. | 60/757 |
| 4,655,044 | 4/1987 | Dierberger et al. | 60/753 |
| 4,800,718 | 1/1989 | Zimmerman | 60/757 |
| 4,887,663 | 12/1989 | Auxier et al. | 60/757 |
| 4,916,906 | 4/1990 | Vogt | 60/757 |
| 5,077,969 | 1/1992 | Liang et al. | 60/757 |

FOREIGN PATENT DOCUMENTS

| | | | |
|---|---|---|---|
| 149474 | 7/1985 | European Pat. Off. | 60/753 |

*Primary Examiner*—Timothy S. Thorpe
*Attorney, Agent, or Firm*—Robert E. Greenstien

[57] ABSTRACT

In a gas turbine liner, air metering passages are placed in dimples in a first liner sheet to provide an air chamber. A second liner sheet contains an air outlet for each dimple. The second sheet masks the metering passage and a portion of the dimple. A coating is applied to the second sheet and extends into the dimple but does not cover the metering passage.

3 Claims, 3 Drawing Sheets

COATED HOT GAS DUCT LINER

TECHNICAL FIELD

This invention relates to hot gas duct liners used gas turbine engines

BACKGROUND OF THE INVENTION

In gas turbine engines, barriers or walls, usually called duct liners, are installed between the hot exhaust gas flow and surrounding engine material and components. To conduct heat effectively and avoid unwanted additions to engine size and weight, these liners are fabricated from thin metal sheets. Physical characteristics of these liners, mainly shape, can inhibit their capacity to conduct heat away from local liner hot spots, which can develop under certain conditions. These liners are exposed to extremely high temperatures, and this creates unusual expansion responses, among them warping and buckling. Those changes can produce hot spots if they restrict cooling air flow through the air metering passages that are often used in current liners.

U.S. Pat. No. 4,887,663, which is assigned to the assignee of this application, and U.S. Pat. No. 4,800,718 illustrate conventional schemes for constructing improved liners for gas turbine engine exhausts. The liner discussed in U.S. Pat. No. 4,800,718 is a complex design of the type known to employ "louvers" in air ducts in conjunction with air dams. The air duct includes an up-steam duct wall that terminates in a downstream edge or lip. A second duct wall is spaced radially outward relative to the first surface lip and defines an elongated louver nozzle through which the cooling air that enters the supply orifices (metering holes) exits. Among the shortcomings of this designs philosophy is that the liner can be very expensive to fabricate and repair, owing to the complex design and the number of components. Heat resistant coatings, used in many applications in gas turbine engines for their beneficial thermal and rear resistance, cannot be applied to liners with that a design, at least not without seriously risking closing off the downstream lip with coating material, which would restrict cooling air flow through the liner. Reducing the cost and complexity of these liners presents obvious benefits, but being able to coat liners without diminishing cooling efficiency and increasing liner weight offers significant improvement. One way to apply coatings is by "plasma spray." This done in coating some exhaust nozzle parts, for instance, the aft divergent flap. One type of coating particularly suited for this environment is Spec PWA 265 coating by United Technologies Corporation, a two-layer, plasma sprayed coating consisting of a nickel bond layer and a yttrium oxide stabilized zirconium oxide ceramic layer. Coatings increase liner operating life by protecting the liner structure from direct contact with hot/corrosive exhaust gases. Coating also simplifies liner repair. A thermally worn-out or sacrificial liner coating simply may be reapplied instead of replacing the entire liner, the conventional approach at this time.

DISCLOSURE OF THE INVENTION

Among the objects of the present invention is to provide an improved thermal liner that is particularly, not exclusively, suited for lining the exhausts in gas turbine engines.

Another object is to provide liners that are easier and less expensive to fabricate, that uses a minimum number of parts, and that can be coated and recoated with durable thermally protective coatings without reducing liner effectiveness and longevity.

According to the present invention, a cooling liner is constructed by fabricating a first sheet containing aerodynamically shaped "dimples," each having an air inlet hole or metering passage to supply cooling air to the liner. A second or "film" sheet is placed over the first sheet (dimple sheet). The second sheet is fabricated, before attachment to the first sheet, with an air outlet that is considerably larger than the air inlet and that partially overlaps the dimple in a special way. The overlap creates an airflow chamber with the dimple that extends from the metering passage to the outlet and supplies cooling air flow to the hot gas side of the liner. With the two sheets attached, preferably by diffusion bonding, a thermal coating is applied to the second sheet. The film sheet performs as a mask. The coating covers the second sheet completely, but, because of the placement of the outlet over the dimple, it also coats part of the dimple but not the metering passage in the dimple.

Among the features of the present invention, it furnishes an inexpensive, highly efficient and easily refurbished liner having only two parts-the dimpled sheet and the film sheet. The invention provides a liner in which a heat resistant coating is applied without changing cooling airflow by closing off the airflow passage from the air inlet.

Other objects, benefits and features of the invention will be apparent to one of ordinary skill in the art from the following discussion.

BEST MODE FOR CARRYING OUT THE INVENTION

Figure 1:
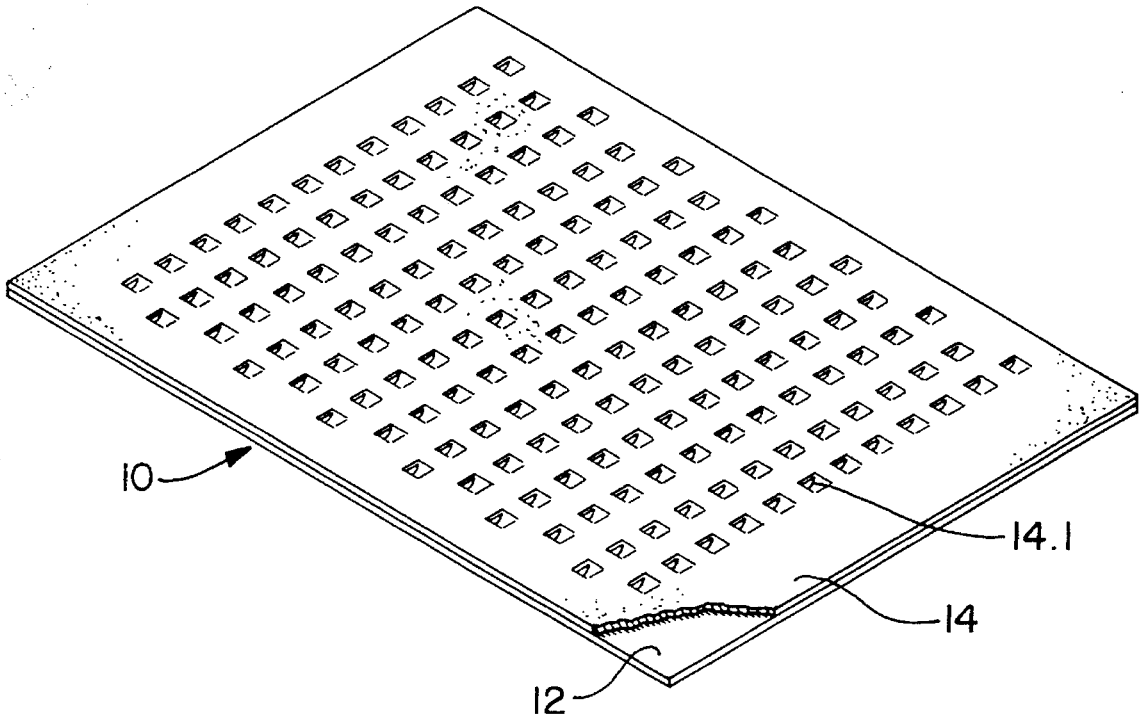
FIG. 1, a perspective view of a liner according to the present invention, shows the dimple sheet and the coated film sheet.
Figure 2:
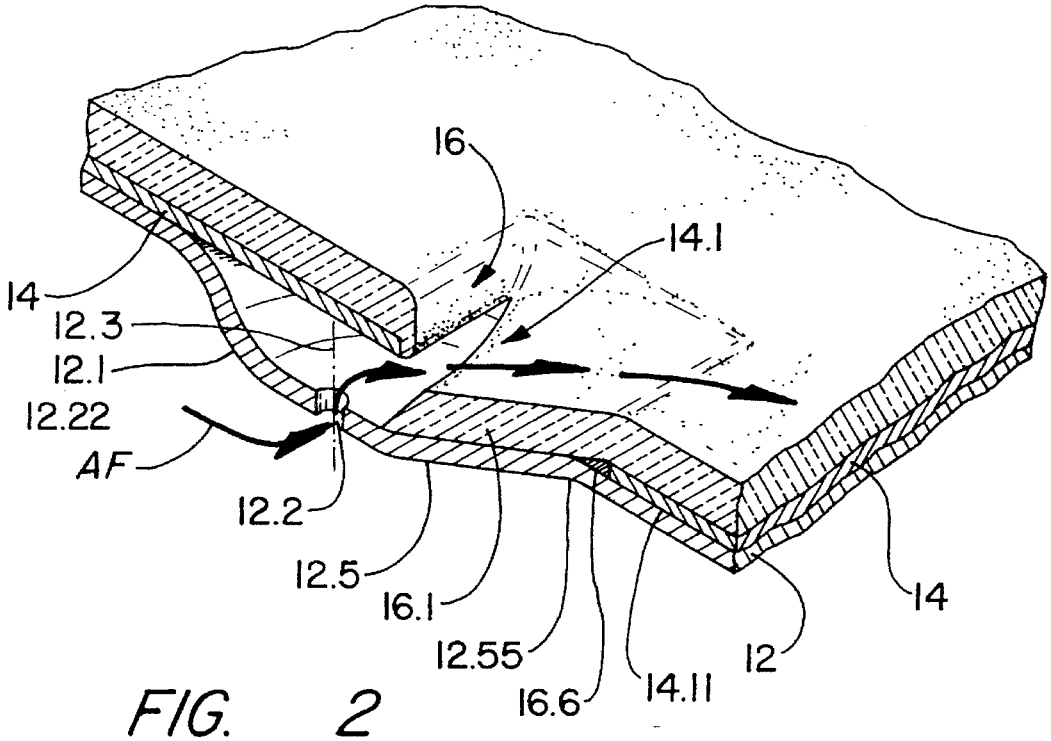
FIG. 2, a perspective cutaway view of a portion of the liner shown in FIG. 1, provides a magnified view of the dimple sheet and the coated film sheet.
Figure 3:
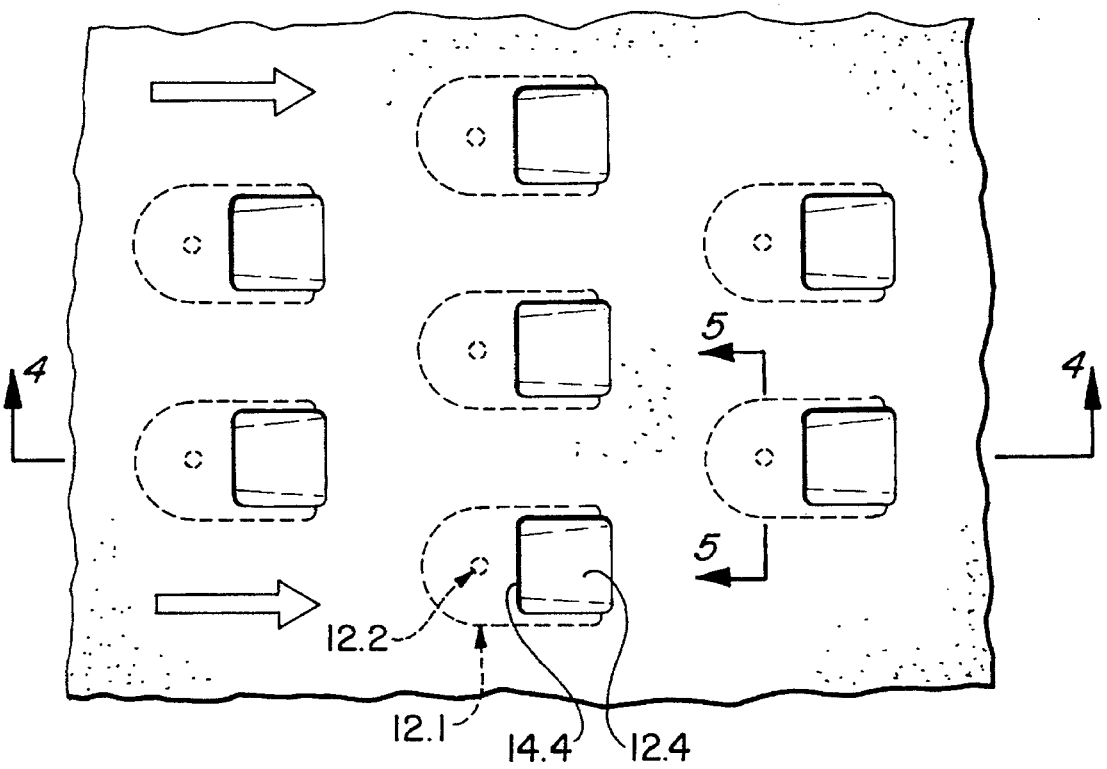
FIG. 3 is a plan view of a portion of a liner embodying the invention.
Figure 4:
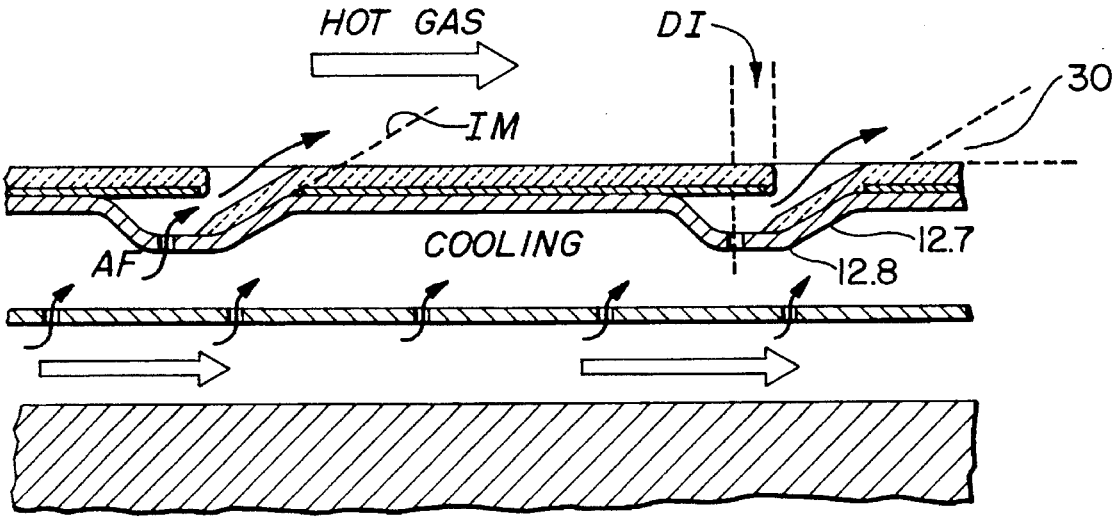
FIG. 4 is section along line 4—4 in FIG. 3.
Figure 5:
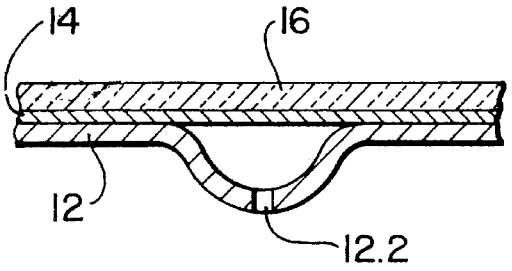
FIG. 5 is a section along 5—5 in FIG. 3.

Referring first to FIG. 1, a liner 10, embodying the present invention, contains a dimple sheet 12 pressed against and film sheet 14. This liner may be used in the exhaust section of a gas turbine engine, for instance, in place of the liner shown with numeral 24 in U.S. Pat. No. 4,800,718. The film sheet 14 contains a plurality of cooling airflow outlets 14.1. FIGS. 2 and 4 help illustrate that the dimple sheet 12 contains a plurality of dimples 12.1 (in effect air chambers), each "tearshaped" and having an air inlet hole or air metering passage 12.2 in a lower, generally flat wall 12.22. It is through this passage that airflow (arrow AF) is applied to the film sheet 14, which is exposed to the hot gas flow GF. The dimples are formed by using a tool and die on a flat sheet of suitable metallic and thermal qualities. Diffusion bonding is the favored technique for joining the two sheets 12 and 14. Ideally, the film sheet's thickness should be as small as possible to produce smooth airflow and minimize liner weight. The dimple sheet, somewhat conversely, must have a thickness that is sufficient to permit stamping the dimple's aerodynamic shape in the sheet without creating local fractures and weak points.

Figure 7:
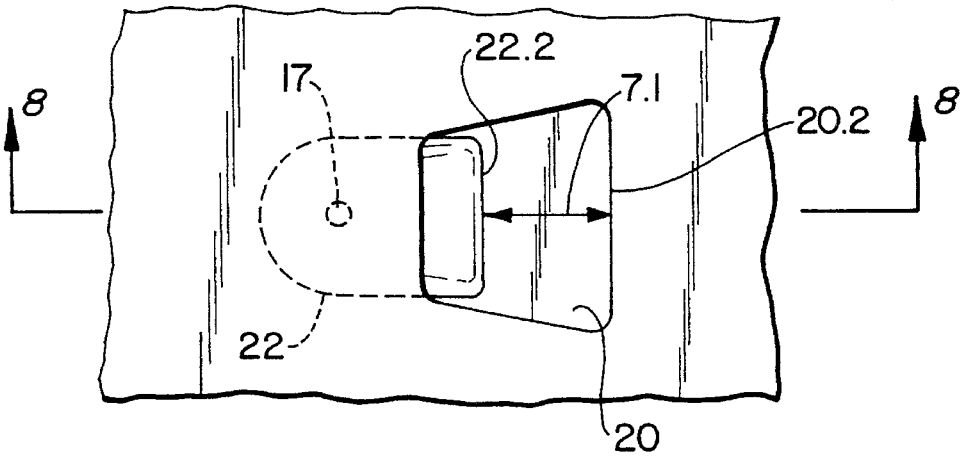
FIG. 7 (PRIOR ART)
FIG. 7 is a plan view of a liner of the type shown in FIG. 6.

It should be noticed that a coating 16 has been applied to the film sheet. The coating is presumed to be a known high temperature coat frequently used in such applications, such as the stated PWA 265 coating or a coating of magnesium zirconate. The way that the outlets 14.1 on the film sheet 14 overlay the dimples creates a mask, allowing some (numeral 16.1 ) of the coating to cover the trailing edge 12.5 of the dimple 12.1 (down-stream from the metering passage). In this respect, it should considered that the downstream edge 14.11 of the air outlet 14.1 is essentially aligned with the downstream edge 12.55 by placing the edge 14.11 along an imaginary line (numeral IM in FIG. 4) that defines the dimple's trailing edge. As a consequence, a small space 16.6 is left that is not filled with the coating. This approach prevents the coating 16 from filling the metering passage but provides coating protection to that portion of the dimple exposed to the hot gases GF. Contrast this with the prior art shown in FIG. 7, where there is a large distance (arrow 7.1) between the edges 22.2 and 20.2. It should be appreciated that the size of the outlets can be established so that the ratio between the metering passage's area and the outlet is correct taking into account the reduction in outlet area caused by the coating, as explained previously.

Figure 6:
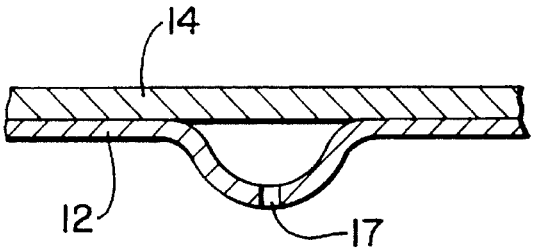
FIG. 6 (PRIOR ART)
FIG. 6 is a section of a liner of the type known in the prior art.
Figure 8:
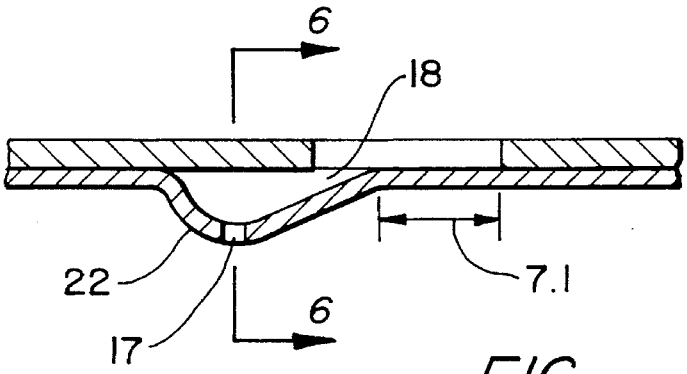
FIG. 8 (PRIOR ART)
FIG. 8 is section line 8—8 in FIG. 7.

In comparison, coating prior art liners is problematic because the coating may restrict the outlet area. In the prior art design shown if FIGS. 6,7 and 8, for example, the metering passage 17 would be covered with the coating 9 (not shown), and the coating would probably fill the outlet 18. The reason is that the outlet is not located properly for use of a coating. Furthermore, the shape of the dimple 22 is one that places the metering passage 17 very close to the outlet, where it is likely to fill with the coating material.

The overall thickness of the liner is determined following traditional design criteria. Requirements include low cycle fatigue, high cycle fatigue, strength margins of safety and engine operating conditions such as pressure, temperature and acoustics. Liner geometry is another consideration. For example, the shape of the engine exhaust in which the liner is used may be straight or bent in whole or in part depending on engine design. The manner in which the liner is attached to the engine also must be considered in deciding on sheet thickness. Liner strength is determined from the strength of the two sheets when bonded, and diffusion bonding is preferred. Generally speaking, it is considered best to use a film liner that is as thin as possible to reduce weight and provide a very smooth air flow surface. The dimple sheet must be of sufficient thickness to accept the dimples without fracturing and creating weak areas when the dimples are stamped on the dimple sheet with a tool and die.

In thermodynamic and aerodynamic terms, dimple geometry is dependent on several factors, most notably cooling efficiency, manufacturing capabilities and coating thickness (to avoid choking off air flow). It has been found that it is ideal to have a dimple exit area that is about three to seven times the area of inlet or metering hole. The ramp angle, number 30, should not be greater than thirty degrees to the air flow or gas path. It is well known that the area of the metering hole is determined by the known relationship (Equation 1): Exit Area=$5\pi r$- h.w, where r is the radius of the metering passage, h is the height of the outlet and w is the width of the outlet.

In one version of the invention, the exit area is located about 0.060 inches behind the metering hole's centerline 12.3, creating a film sheet overlap that prevents coating material from entering the dimple to the extent that it could completely close off the metering. This means that a thick coating can be applied. The outlet exit area is the result of the coating process and thickness, as illustrated in FIG. 2. Since the height and width of the area are variables, a designer must determine one or the other first. For example, the width W may be first determined by the manufacturing, coating and heat transfer requirements for the liner. The coating requirements are determined using known coating characteristics to match the coating to the temperature and the life of the liner. It has been found, based mainly on limitations in tooling and on heat transfer requirements that the minimum flat space between dimples can be 0.120 inches, minimum. Optimum cooling efficiency suggests a high dimple density. But the dimple sheet could be weak and the cost of manufacture could be very high if too many dimples are provided. Use of the invention, should take into account the inverse relationship between dimple density and liner strength. Assuming that there is the stated minimum flat space, the height can be computed. The dimple sheet must be made thicker as dimple depth is increased. The dimple forming operation, with a tool and die, stretches the sheet metal when forming the dimple sheet, which draws metal from the dimple perimeter. If the-sheet is too thin, it will crack. Alloys such as INCONEL brand 625 and HAYNES brand 230 may be used. They have very good strength and stability at high temperature (greater than 1500 degrees F) along with excellent ductility and elongation at room temperatures for fabrication of the dimples in sufficient densities for most applications.

A dimple's overall length and width is related to the dimple depth, the ramp angle 12.7, bend radii 12.8 and metering passage location. The particular selection of these dimensions is not a factor in the invention but instead something that must be determined empirically, being dependent on the coating characteristics, metal and heat transfer requirements. It has been found that bend radii of 1.5 times the sheet thickness provides good sheet strength and easily fabricated dimples.

With the benefit of the foregoing discussion on the invention, one skilled in the art may be able to make modifications to the invention, in whole or in part and in addition to any set forth previously, without departing from the true scope and spirit of the invention.

We claim:

1. A cooled liner comprising a first planar sheet pressed against a second planar sheet to which cooling air is applied, characterized in that:

the first sheet contains an airflow outlet;

the second sheet comprises a raised portion elevated away from the first sheet from a first location to a second location on the second sheet to define an air chamber between the first sheet and the second sheet, and an airflow metering passage that is located at a third location in said raised portion at a first distance from said first location, said airflow outlet having a line projection on the second sheet that extends from a fourth location to a fifth location, the fourth location being between said third location and said second location and at a second distance from said first location that is greater than said first distance, said fifth location being at a greater distance from said first location than said second location; and a coating on the first sheet and a like coating originating at said said fourth location to said fifth location on the second sheet.

2. The liner described in claim 1, further characterized in that:

there is a ratio of at least three and no more than seven between the area of the air flow outlet to area of the metering passage.

3. The liner described in claim 2, further characterized in that:

the said raised portion comprises a dimple with a surface parallel to the first sheet and containing the metering passage, said surface extending between a sixth location between said first and third locations to a location between said fourth and fifth locations, said dimple having a wall that extends from said sixth location along a line to a planar portion of the second sheet, said line intersecting the first sheet at a seventh location between said fourth and fifth locations, so that a planar area of the second sheet between said seventh location and said fifth location is not covered by the first sheet.

* * * * *